US011510008B2

(12) United States Patent
Kim

(10) Patent No.: US 11,510,008 B2
(45) Date of Patent: Nov. 22, 2022

(54) STICK-TYPE VIBRATING DRIVER

(71) Applicant: Actuward. Co. Ltd., Gyeonggi-do (KR)

(72) Inventor: Dong-Man Kim, Seoul (KR)

(73) Assignee: ACTUWARD. CO. LTD.

( * ) Notice: Subject to any disclaimer, the term of this patent is extended or adjusted under 35 U.S.C. 154(b) by 127 days.

(21) Appl. No.: 16/971,124

(22) PCT Filed: Feb. 13, 2019

(86) PCT No.: PCT/KR2019/001748
§ 371 (c)(1),
(2) Date: Aug. 19, 2020

(87) PCT Pub. No.: WO2019/164174
PCT Pub. Date: Aug. 29, 2019

(65) Prior Publication Data

US 2021/0112343 A1 Apr. 15, 2021

(30) Foreign Application Priority Data

Feb. 20, 2018 (KR) ..... 10-2018-0019639

(51) Int. Cl.
*H04R 9/02* (2006.01)

(52) U.S. Cl.
CPC ..... *H04R 9/025* (2013.01)

(58) Field of Classification Search
CPC ..... H04R 9/025; H04R 9/043; H02K 33/00
See application file for complete search history.

(56) References Cited

U.S. PATENT DOCUMENTS 4,675,907 A 6/1987 Itagaki et al.
2013/0241322 A1* 9/2013 Lee ..... H02K 33/16 310/25

(Continued)

FOREIGN PATENT DOCUMENTS

KR 20040084363 A * 6/2004
KR 10-2004-0084363 10/2004

(Continued)

OTHER PUBLICATIONS

International Search Report from PCT/KR2019/001748, dated Jun. 14, 2019, pp. 1-7, including English translation.

(Continued)

*Primary Examiner* — Sunita Joshi
(74) *Attorney, Agent, or Firm* — The Belles Group, P.C.

(57) ABSTRACT

The present invention relates to a stick-type vibrating driver and, more specifically, to a stick-type vibrating driver implemented so as to enable vibration to be transmitted, by using a planar movable coil plate and a stick-shaped magnet, to an object to be vibrated. The stick-type vibrating driver according to the present invention can comprise: an outer body formed in a stick shape; a magnetic circuit part formed inside the outer body, and having a pair of magnetic bodies spaced apart with the movable coil plate therebetween; a vibrating part formed inside the outer body, and vertically vibrating according to the driving of the magnetic circuit part in a state in which the upper and lower ends of the movable coil plate are fixed; and upper and lower metal suspensions respectively connected between the outer body and the vibrating part.

10 Claims, 7 Drawing Sheets

(56) References Cited

U.S. PATENT DOCUMENTS

| | | | | |
|---|---|---|---|---|
| 2017/0133918 | A1* | 5/2017 | Xu | H02K 33/16 |
| 2018/0048962 | A1 | 2/2018 | Kang | |

FOREIGN PATENT DOCUMENTS

| | | |
|---|---|---|
| KR | 10-1116307 | 3/2012 |
| KR | 10-1154253 | 6/2012 |
| KR | 10-20141469555 | 12/2014 |
| KR | 10-1710861 | 2/2017 |
| KR | 10-2017-0112611 | 10/2017 |

OTHER PUBLICATIONS

Farid Khan et al., Copper foil-type vibration-based electromagnetic energy harvester., Journal of Journal of Micromechanics and Microengineering., Published Nov. 9, 2010., The University of British Columbia, Vancouver, BC V6T 1Z4, Canada., pp. 1-11.
European Search Report 19758244.8 dated Oct. 5, 2021.

* cited by examiner

【FIG 1】
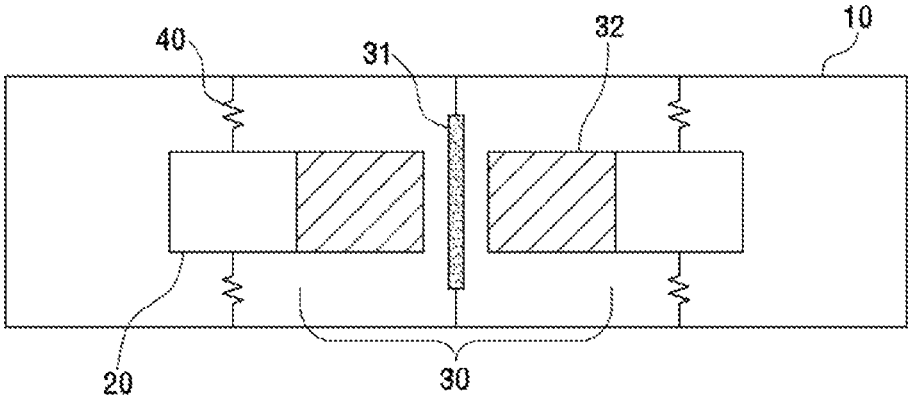
【FIG 2】
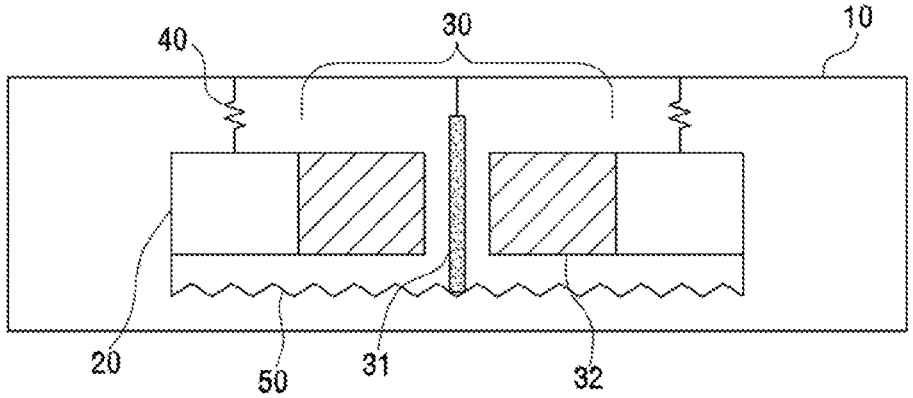

【FIG 3】
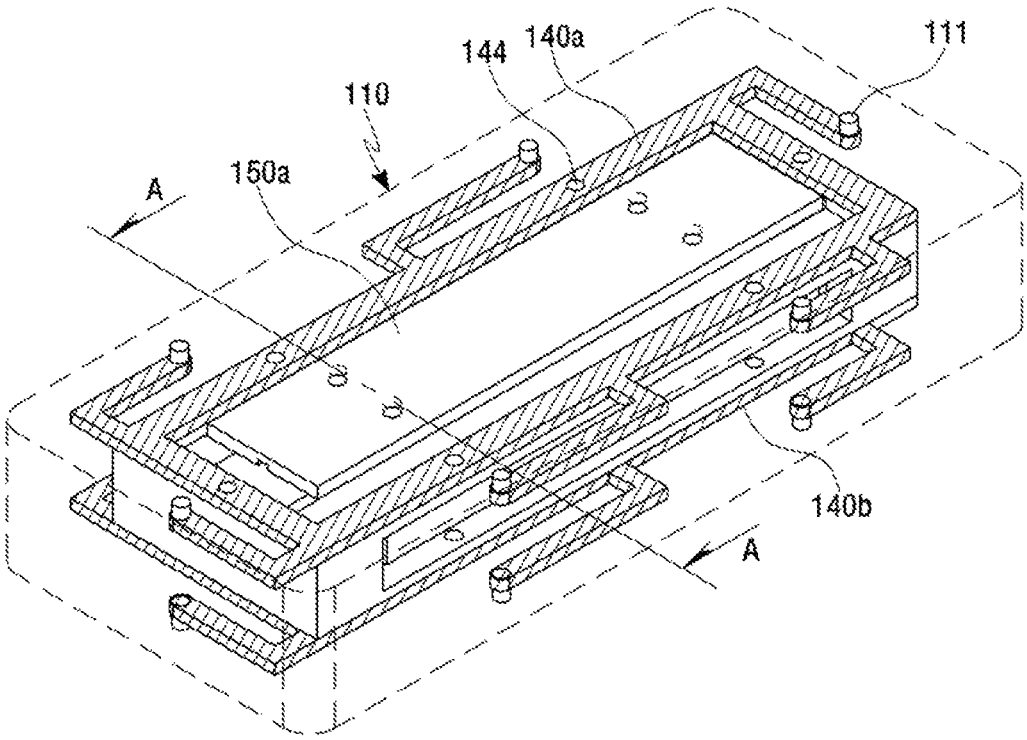

【FIG 4】
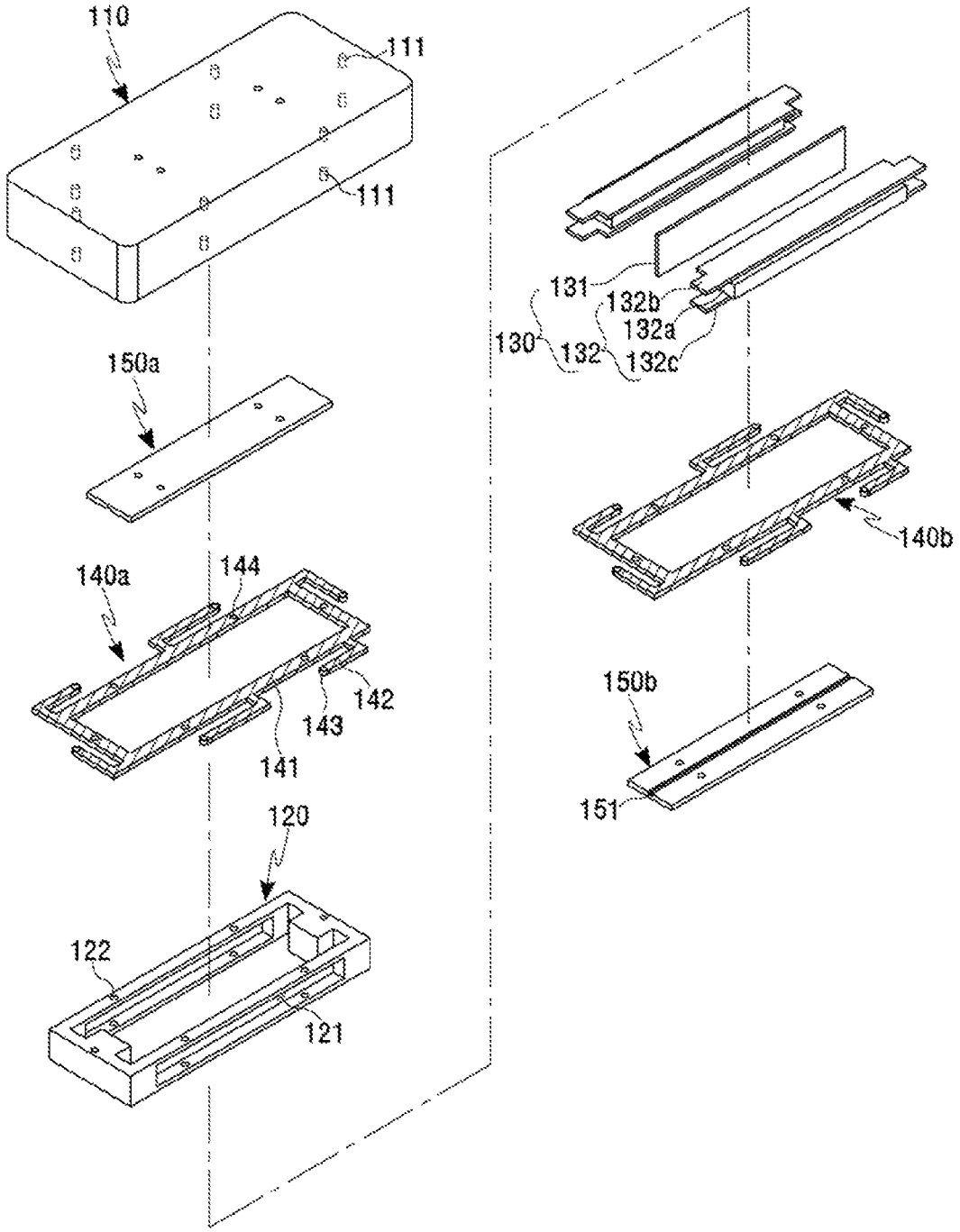

【FIG 5】
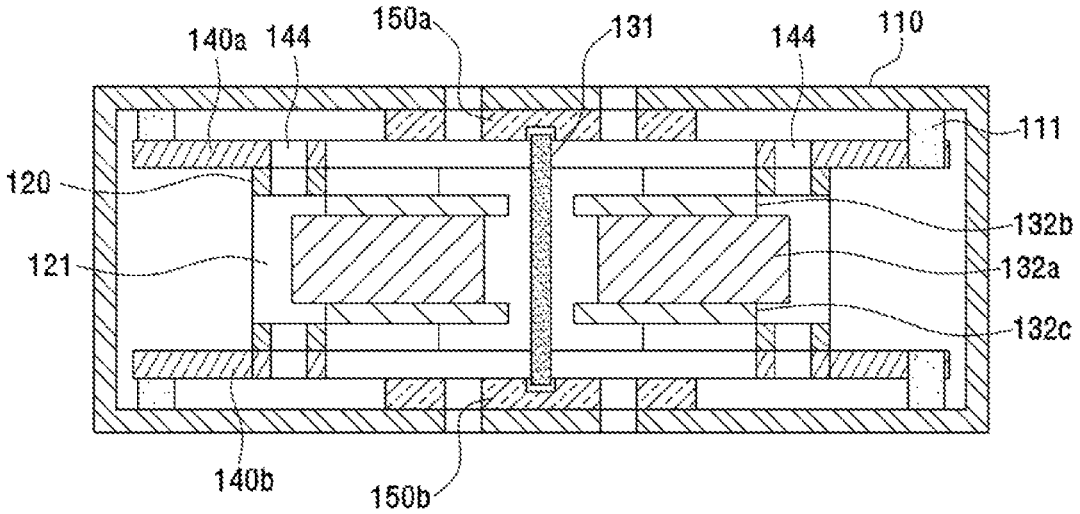
【FIG 6】
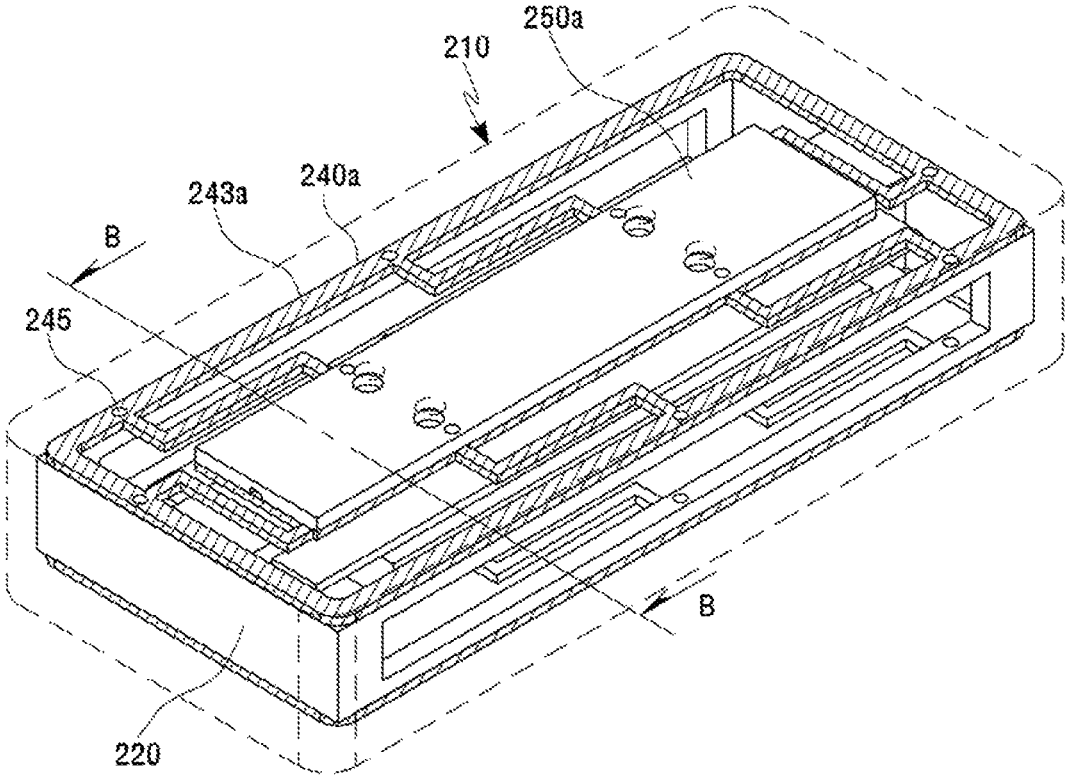

【FIG 7】
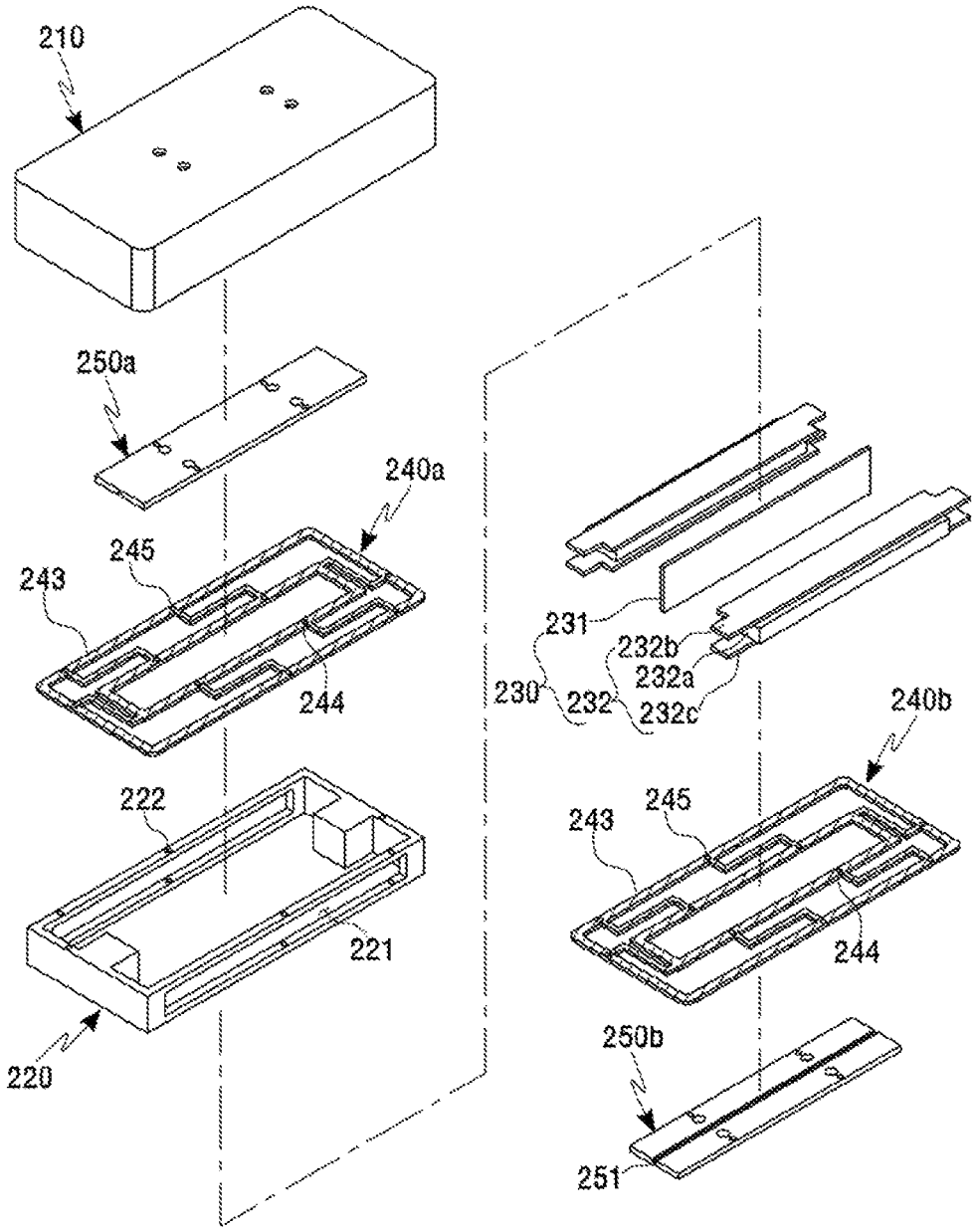

【FIG 8】
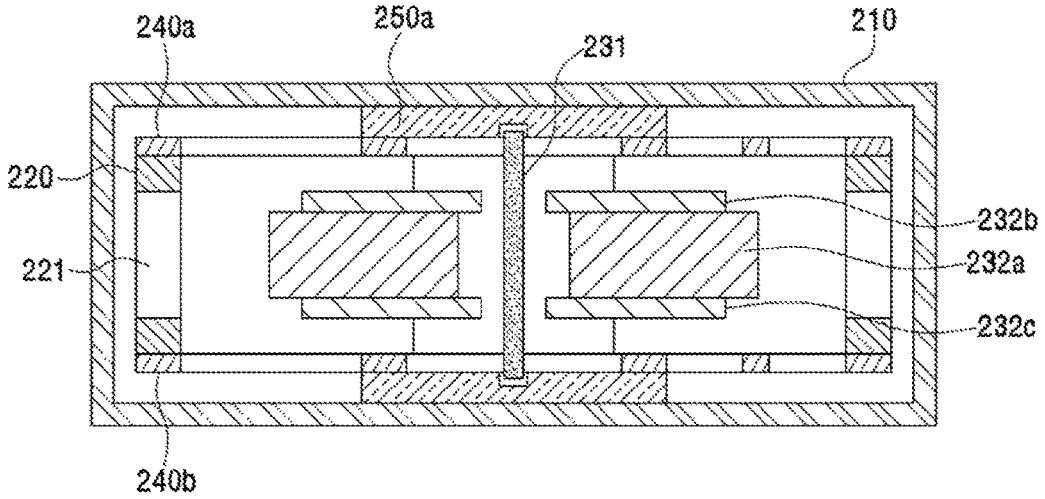
【FIG 9】
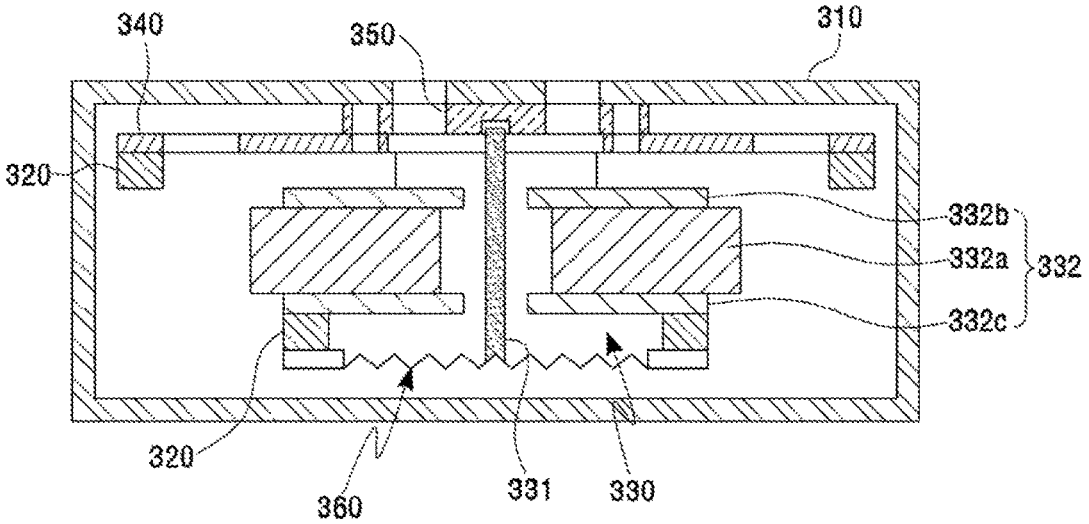

【FIG 10】
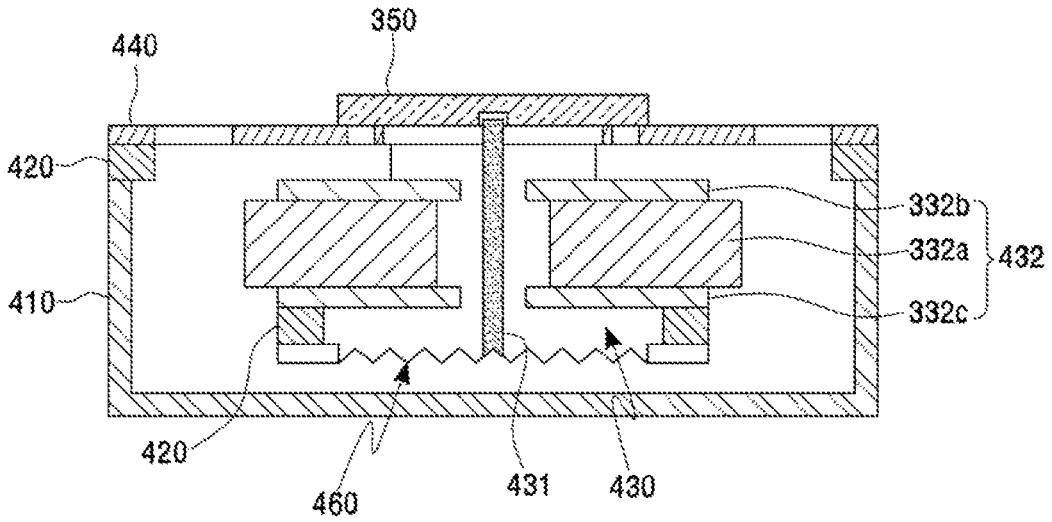
【FIG 11】
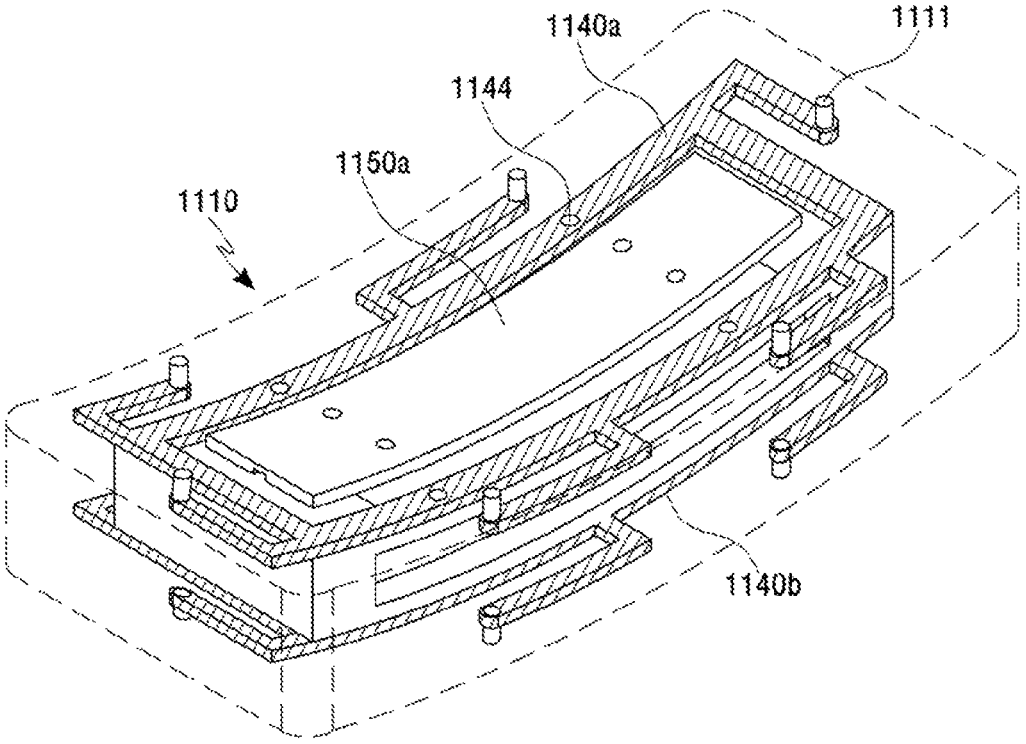

STICK-TYPE VIBRATING DRIVER

CROSS-REFERENCE TO RELATED PATENT APPLICATIONS

The present application is a U.S. national stage application under 35 U.S.C. § 371 of PCT Application No. PCT/KR2019/001748, filed Feb. 13, 2019, which claims priority to Korean Patent Application No. 10-2018-0019639, filed Feb. 20, 2018. The disclosures of the aforementioned priority applications are incorporated herein by reference in their entireties.

TECHNICAL FIELD

The present invention relates to a stick-type vibrating driver, and more particularly, to a stick-type vibrating driver implemented so as to enable vibration to be transmitted to an object to be vibrated by using a planar movable coil plate and a stick-shaped magnet.

BACKGROUND ART

A vibrating driver refers to a device for transmitting vibration to an object to be vibrated.

Typically, a vibrating driver that is manufactured by removing a vibrating plate from a so-called cone-type speaker device and directly attaching one of a circular magnet and a circular voice coil to the object to be vibrated has been used.

This cone-type vibrating driver has a disadvantage of requiring a flat surface for bonding of an elliptical bobbin. Also, when a unit of the vibrating driver has a large size, a magnetic body may have a large circular shape to maintain a circular structure and thus increase in weight and may not effectively transmit vibration energy. Furthermore, since the bobbin has a weak bonding force in consideration of a weight thereof, the cone-type vibrating driver may not be attached to the object to be vibrated for a long-term period.

Korean Registered Patent No. 10-1469555 discloses a 'vibration speaker', and this vibration speaker is attached to an artificial structure and provides sound in conjunction with vibration.

This patent provides a plate-shaped mastoid supplying sound or vibration to the artificial structure by using a magnet and a magnetic body of a voice coil.

The 'vibration speaker' in Korean Registered Patent No. 10-1469555 is not the above-described cone-type vibrating driver but has limitations similar to the cone-type vibrating driver because the vibration speaker has a circular vibration structure.

The above-described typical vibrating devices have a limitation in that a plurality of vibrating drivers are required when the object to be vibrated is excessively long or wide due to a typical technical limitation.

Also, the typical vibrating devices have a disadvantage of having a weak bonding force or hardly performing bonding when the object to be vibrated has a curved surface.

[Related art document] (Patent document 1) Korean Registered Patent No. 10-1469555

DISCLOSURE OF THE INVENTION

Technical Problem

The present invention provides a vibrating driver that is slim, light, and capable of freely adjusting a length of the driver by using a track-type voice PCB having a multi-layer structure in a longitudinal direction and a movable coil to resolve the above-described limitations.

Technical Solution

An embodiment of the present invention provides a stick-type vibrating driver including: an outer body; a magnetic circuit part formed inside the outer body and including one pair of magnetic bodies spaced apart with a movable coil plate therebetween; a vibrating part formed inside the outer body and including at least the one pair of magnetic bodies configured to vertically vibrate according to driving of the magnetic circuit part in a state in which upper and lower ends of the movable coil plate are fixed; and upper and lower metal suspensions respectively connected between the outer body and the vibrating part.

In an embodiment, wherein the outer body may have a predetermined rectangular shape.

In an embodiment, the upper and lower ends of the movable coil plate may be fixed to upper and lower fixing parts attached to top and bottom surfaces of the outer body, respectively.

In an embodiment, the vibrating part may further include a base frame connected to the one pair of magnetic bodies.

In an embodiment, each of the upper and lower metal suspensions may include an inside edge, an outside edge, and a plurality of bridges configured to connect the inside edge and the outside edge, the inside edge may be connected to upper and lower ends of the outer body, and the outside edge may be connected to the vibrating part.

In an embodiment, the upper and lower ends of the movable coil plate may be fixed to upper and lower fixing parts attached to the outer body, respectively, the vibrating part may include a base frame configured to constitute an external case, the inside edges of the upper and lower metal suspensions may be connected to the upper and lower fixing parts, respectively, and the outside edges of the upper and lower metal suspensions may be connected to outside edges of top and bottom surfaces of the base frame, respectively.

In an embodiment, each of the upper and lower metal suspensions may include an inside edge and a plurality of free ends connected from the inside edge, and each of the plurality of free ends may have a bent shape having at least one bent portion.

In an embodiment, at least one bush may be formed in the outer body, the vibrating part may include a base frame configured to constitute an outer case, each of front ends of the free ends of the upper and lower metal suspensions may be connected to the bush, and inside edges of the upper and lower metal suspensions may be connected to outside edges of top and bottom surfaces of the base frame, respectively.

In an embodiment, each of the upper and lower metal suspensions may include s an inside edge, a plurality of bridges connected from the inside edge, and an outside edge connected to the other end of each of the bridges, and each of the plurality of bridges may have a bent shape having at least one bent portion.

In an embodiment, each of the outer body, the magnetic circuit part, the vibrating part, and the metal suspension may be curved by a predetermined radius in a longitudinal direction.

In an embodiment, the outer body may be attached to an object to be vibrated, and when an attachment surface of the object to be vibrated is concave or convex, an attachment surface of the outer body may be concave or convex.

In an embodiment of the present invention, a stick-type vibrating driver includes: an outer body attached to an object to be vibrated and having a stick shape having at least top and bottom surfaces; a printed circuit board (PCB) movable coil plate disposed inside the top and bottom surfaces of the outer body and having fixed upper and lower ends; a magnetic body including a magnet and a magnetic plate, which are spaced apart with the movable coil plate therebetween; a base frame connected to the magnetic body; and a metal suspension part configured to enable the base frame to vibrate by connecting each of the top and bottom surfaces of the outer body with the base frame.

In an embodiment of the present invention, a stick-type vibrating driver includes: an outer body; a magnetic circuit part formed inside the outer body and including one pair of magnetic bodies spaced apart with a movable coil plate therebetween; a vibrating part formed inside the outer body and including at least the one pair of magnetic bodies configured to vertically vibrate according to driving of the magnetic circuit part in a state in which upper and lower ends of the movable coil plate are fixed; a metal suspension connected between the outer body and an upper end of the vibrating part; and a damper connected to a lower end of the movable coil plate and a lower side of the vibrating part.

In an embodiment of the present invention, a stick-type vibrating driver includes: a fixing part attached to an object to be vibrated; an outer body; a magnetic circuit part formed inside the outer body and including one pair of magnetic bodies spaced apart with a movable coil plate therebetween; a vibrating part connected to an inside surface of the outer body and including at least the one pair of magnetic bodies configured to vertically vibrate according to driving of the magnetic circuit part in a state in which an upper end of the movable coil plate is fixed to the fixing part, and a lower end of the movable coil plate is fixed to a damper; a metal suspension connected between the outer body and the fixing part; and a damper connected to a lower end of the movable coil plate and a lower side of the vibrating part.

Advantageous Effects

According to the embodiments of the present invention, the vibrating driver may be slim, light, and freely adjust the length of the driver by using the track-type voice PCB having the multi-layer structure in the longitudinal direction and the movable coil instead of using a typical circular voice coil wound by a copper wire.

Also, since the vibrating driver may be manufactured to have the long length regardless of the shape of the object to be vibrated and attached even to the curved surface of the object to be vibrated, the vibrating driver may have an extremely wide usage range.

Also, since the demand of coupling sound and vibration is expected to explosively increase, this stick-type vibrating driver may be attached to a slimmer TV panel to perform vibration transmission in conjunction with sound generation and further applied to a game console and a theater.

BRIEF DESCRIPTION OF THE DRAWINGS

FIG. 1 is a basic conceptual view illustrating a stick-type vibrating driver according to the present invention.

FIG. 2 is another basic conceptual view illustrating the stick-type vibrating driver according to the present invention.

FIG. 3 is a perspective view illustrating a stick-type vibrating driver according to a first embodiment of the present invention.

FIG. 4 is an exploded perspective view illustrating the stick-type vibrating driver according to the first embodiment of the present invention.

FIG. 5 is a cross-sectional view taken along line A-A and illustrating the stick-type vibrating driver according to the first embodiment of the present invention.

FIG. 6 is a perspective view illustrating a stick-type vibrating driver according to a second embodiment of the present invention.

FIG. 7 is an exploded perspective view illustrating the stick-type vibrating driver according to the second embodiment of the present invention.

FIG. 8 is a cross-sectional view taken along line B-B and illustrating the stick-type vibrating driver according to the second embodiment of the present invention.

FIG. 9 is a cross-sectional structure view illustrating a stick-type vibrating driver according to a third embodiment of the present invention.

FIG. 10 is a cross-sectional structure view illustrating a stick-type vibrating driver according to a fourth embodiment of the present invention.

FIG. 11 is a perspective view illustrating a modified stick-type vibrating driver of the first embodiment of the present invention.

MODE FOR CARRYING OUT THE INVENTION

Hereinafter, a structure and an effect of a stick-type vibrating driver according to the present invention will be described with reference to the accompanying drawings.

The detailed description on the specific embodiment illustrated in the accompanying drawings should be read in conjunction with the accompanying drawings, and the drawings are regarded as a part of the description of the entire invention. The terminology used herein is for the purpose of describing particular embodiments only and is not intended to be limiting of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are used for convenience of description and are not intended to limiting of the invention.

When it is described that an element is "coupled to", "engaged with", or "connected to" another element, it should be understood that the element may be directly coupled or connected to the other element but still another element may be "coupled to", "engaged with", or "connected to" the other element between them.

It will be understood that the same or similar components in the drawings are designated by the same reference numerals as far as possible even if they are shown in different drawings. In the following description of the present invention, the detailed description of known functions and configurations incorporated herein will be omitted to avoid making the subject matter of the present invention unclear.

FIG. 1 is a basic conceptual view illustrating a stick-type vibrating driver according to the present invention, and FIG. 2 is another basic conceptual view illustrating the stick-type vibrating driver according to the present invention.

Referring to FIG. 1, the stick-type vibrating driver according to the present invention may include an outer body 10, a vibrating part 20, a magnetic circuit part 30, and a metal suspension 40.

The outer body 10 may have a rectangular frame shape. The outer body 10 may be a stick-type long rectangular structure and attached to an object to be vibrated (hereinafter, referred to as a vibrated object).

The vibrating part 20 generates an induced electromotive force by Fleming's left hand rule and the Lorentz force law according to a magnetic circuit configuration of the magnetic circuit part 30 and vertically vibrates by a fixed movable coil plate 31.

The vibrating part 20 may vertically vibrate as connected to the outer body 10 by means of the metal suspension and transmit vibration to the vibrated object through the metal suspension 40.

Here, the vibrated object may correspond to an object that requires a vibration effect according to a sound, e.g., a vibration chair for exhibiting a fourth-dimensional effect in a theater, an object that requires vibration in an experience center such as clothing or gloves related to a game in a fourth-dimensional game industry, and a wearable device having a fourth-dimensional vibration mechanism.

The magnetic circuit part 30 includes one pair of magnetic bodies 32 that are spaced by a predetermined distance from each other while facing each other and a movable coil plate 31 disposed between the one pair of magnetic bodies 32.

The one pair of magnetic bodies 32, which face each other, may have the same configuration including a magnet and upper and lower magnetic plates (yoke) disposed on top and bottom surfaces of the magnet, respectively.

Magnets provided in the facing magnetic bodies 32 may have opposite polarities to act an attractive force therebetween, and the movable coil plate 31 may maintain the same distance from the magnetic bodies 32 disposed at both sides so as to receive the same magnetic force.

Here, the movable coil plate 31 has a structure in which upper and lower ends thereof are fixed to form a mechanism in which the both side magnetic bodies 32 vertically vibrate by the fixed movable coil plate 31.

The vibrating part 20 may be connected to the magnetic bodies 32 as a base frame.

The movable coil plate 31 may be a printed circuit board (PCB) or a flexible printed circuit board (FPCB), and a movable coil may be printed to form a track-shaped pattern on the movable coil plate 31**.

Referring to FIG. 2, a stick-type vibrating driver in FIG. 2 may have a principle similar to that of FIG. 1.

The stick-type vibrating driver in FIG. 2 may include an outer body 10, a vibrating part 20, a magnetic circuit part 30, a metal suspension 40, and a damper 50.

A structure of the outer body 10, the vibrating part 20, the magnetic circuit part 30, and the metal suspension 40 is the same as that in FIG. 1, and a structure of connecting of connecting the damper 50 instead of connecting the metal suspension 40 disposed below the vibrating part 20 to the outer body 10 is different.

That is, a structure for fixing components is formed by connecting the damper 50 to both ends of a structure connected to a lower side of the vibrating part 20, a lower end of the movable coil plate 31 to the damper 50, and an upper end of the movable coil plate 31 to the outer body 10 or an upper end fixing part.

The damper 50 may have a wrinkled shape made of a fabric material or an elastic material. Alternatively, the metal suspension may be used as the damper.

Hereinafter, structures of the stick-type vibrating drivers in FIGS. 1 and 2 will be described in more detail for each embodiment.

FIG. 3 is a perspective view illustrating a stick-type vibrating driver according to a first embodiment of the present invention, FIG. 4 is an exploded perspective view illustrating the stick-type vibrating driver according to the first embodiment of the present invention, and FIG. 5 is a cross-sectional view taken along line A-A and illustrating the stick-type vibrating driver according to the first embodiment of the present invention.

As illustrated in FIGS. 3 to 5, the stick-type vibrating driver according to the first embodiment of the present invention may include an outer body 110, a base frame 120, a magnetic circuit part 130, and upper and lower metal suspensions 150*a* and 150*b*.

The outer body 110 may be manufactured by resin molding and have a stick-type long rectangular shape. The outer body 110 may be formed with a box-shaped structure or a structure having top and bottom surfaces and columns at corners.

The outer body 110 may be an outer housing of the stick-type vibrating driver.

The magnetic circuit part 130 may be disposed at a central portion of the outer body 110, the movable coil plate 131 may be disposed at a central portion of the magnetic circuit part 130, and one pair of magnetic bodies 132 may be spaced by the same distance from both side of the movable coil plate 131.

The movable coil plate 131 may be a printed circuit board (PCB), and a conductive coil may form a track-shaped pattern on the movable coil plate 131.

The movable coil plate 131 has an upper end fixed to a guide groove 151 of an upper fixing part 150*a* and a lower end fixed to a guide groove 151 of a lower fixing part 150*b* in a standing state.

A magnet 132*a* is disposed between the one pair of magnetic bodies 132, and magnetic plates (yokes) 132*b* and 132*c* are attached to top and bottom surfaces of the magnet 132*a*, respectively.

The magnetic circuit part 130 is disposed at and fixed to the base frame 120, and the magnetic body 132 is inserted to each of left and right insert grooves 121 of the base frame 120 and fixed to the base frame 120.

The magnetic body 132 and the base frame 120 constitute the vibrating part that vertically vibrates by the induced electromotive force of the magnetic circuit.

The upper and lower metal suspensions 140*a* and 140*b* are disposed above and below an assembly in which the magnetic circuit part 130 is coupled with the base frame 120.

The upper and lower metal suspensions 140*a* and 140*b* include an inside edge 141 and a plurality of bridges 142 each having at least one bent portion extending to the inside edge 141. Each of the upper and lower metal suspensions 140*a* and 140*b* has a metal thin-film shape.

Bolt holes 143 and 144, to which bolts are able to be fastened, may be formed at an end of the bridge 142 and the inside edge 141 of the upper and lower metal suspensions 140*a* and 140*b*, respectively, and a bush 111 having a bolt column shape may be formed appropriately in the outer body 110 in correspondence to the bolt holes 143 and 144.

The upper metal suspension 140*a* is fastened with the bush 111 of the outer body 110 through the bolt hole 143 in an upward direction and fastened with a fastening tap 122 of the base frame 120 through the bolt hole 144 in a downward direction. Likewise, the lower metal suspension 140*b* is fastened with the bush 111 of the outer body 110 through the bolt hole 143 in a downward direction and fastened with the fastening tap 122 of the base frame 120 through the bolt hole 144 in an upward direction.

Hereinafter, an operation of the stick-type vibrating driver that is constituted as described above will be described.

The movable coil plate 131 passes through an air gap of the magnetic circuit and is inserted and fixed to upper and lower guide grooves 151 of the fixing parts 150*a* and 150*b*, and the base frame 120, which constitutes the entire magnetic circuit, is fixed to the outer body 110 by using the metal suspensions 140*a* and 140*b*.

The upper and lower fixing parts 150*a* and 150*b* is attached and fixed to the outer body 110 through a bolt hole 152, and the outer body 110 is attached to the vibrated object.

The upper and lower fixing parts 150*a* and 150*b* may be manufactured separately from the outer body 110 or integrated with the outer body 110 depending on necessity.

The induced electromotive force is generated when a current flows through the movable coil patterned on the movable coil plate 131, and the vertical vibrating force is generated to a magnetic field of N and S-poles corresponding to the movable coil by Fleming's left hand rule and the Lorentz force law.

Here, since the movable coil plate 131 is fixed to the upper and lower fixing parts 150*a* and 150*b*, the base frame 110 constituting the magnetic circuit vertically vibrates. Specifically, since the magnetic body 132 constituting the magnetic circuit vertically vibrates, and the magnetic body 132 and the base frame 110 are connected to each other, the base frame 110 vertically vibrates.

This vertical vibration energy is transmitted to the vibrated object through the metal suspensions 140*a* and 140*b*.

FIG. 6 is a perspective view illustrating a stick-type vibrating driver according to a second embodiment of the present invention, FIG. 7 is an exploded perspective view illustrating the stick-type vibrating driver according to the second embodiment of the present invention, and FIG. 8 is a cross-sectional view taken along line B-B and illustrating the stick-type vibrating driver according to the second embodiment of the present invention.

As illustrated in FIGS. 6 to 8, the stick-type vibrating driver according to the second embodiment of the present invention may include an outer body 210, a base frame 220, a magnetic circuit part 230, upper and lower metal suspensions 240*a* and 240*b*, and upper and lower fixing parts 250*a* and 250*b*.

The outer body 210 may be manufactured by resin molding and have a stick-type long rectangular shape. The outer body 210 may be formed with a box-shaped structure or a structure having top and bottom surfaces and columns at corners.

The outer body 210 may be an outer housing of the stick-type vibrating driver.

The magnetic circuit part 230 may be disposed at a central portion of the outer body 210, the movable coil plate 231 may be disposed at a central portion of the magnetic circuit part 230, and one pair of magnetic bodies 232 may be spaced by the same distance from both side of the movable coil plate 231.

The movable coil plate 231 may be a printed circuit board (PCB), and a conductive coil may form a track-shaped pattern on the movable coil plate 131.

The movable coil plate 231 has an upper end fixed to a guide groove 251 of an upper fixing part 250*a* and a lower end fixed to a guide groove 251 of a lower fixing part 250*b* in a standing state.

A magnet 232*a* is disposed between the one pair of magnetic bodies 232, and magnetic plates (yokes) 232*b* and 232*c* are attached to top and bottom surfaces of the magnet 232*a*, respectively.

The magnetic circuit part 230 is disposed at and fixed to the base frame 220, and the magnetic body 232 is inserted to each of left and right insert grooves 221 of the base frame 220 and fixed to the base frame 220.

The magnetic body 232 and the base frame 220 constitute the vibrating part that vertically vibrates by the induced electromotive force of the magnetic circuit.

The upper and lower metal suspensions 240*a* and 240*b* is disposed above and below an assembly in which the magnetic circuit part 230 is coupled with the base frame 220.

The upper and lower metal suspensions 240*a* and 240*b* include an inside edge 241, a plurality of bridges 242 each having at least one bent portion extending from the inside edge 241, and an outside edge 243 connected to ends of the plurality of bridges 242. Each of the upper and lower metal suspensions 240*a* and 240*b* has a metal thin-film shape.

Bolt holes 244 and 245, to which bolts are able to be fastened, may be formed at the inside edge 241 and the outside edge 243 of the upper and lower metal suspensions 240*a* and 240*b*, respectively, and a fastening tap 252 may be formed appropriately in the fixing parts 250*a* and 250*b* and the base frame 120 in correspondence to the bolt holes 244 and 245.

The inside edge 241 of the upper metal suspension 240*a* is fastened with the fastening tap 252 of the upper fixing part 250*a* through the bolt hole 244 in an upward direction and fastened with the fastening tap 222 of the base frame 220 through the bolt hole 245 of the outside edge 243 in a downward direction. Likewise, the inside edge 241 of the lower metal suspension 240*b* is fastened with the fastening tap 252 of the lower fixing part 250*b* through the bolt hole 244 in a downward direction and fastened with the fastening tap 222 of the base frame 220 through the bolt hole 245 of the outside edge 243 in an upward direction.

FIG. 9 is a cross-sectional structure view illustrating a stick-type vibrating driver according to a third embodiment of the present invention.

As illustrated in FIG. 9, the stick-type vibrating driver according to a third embodiment of the present invention has the same constitution as that of the second embodiment of the present invention except for a lower end structure. That is, in the stick-type vibrating driver according to the third embodiment, the lower metal suspension connection structure is replaced by a damper.

The stick-type vibrating driver according to the third embodiment of the present invention may include an outer body 310, a base frame 320, a magnetic circuit part 330, a metal suspension 340, and a fixing part 350.

The outer body 310 may be manufactured by resin molding and have a stick-type long rectangular shape. The outer body 310 may be formed with a box-shaped structure or a structure having top and bottom surfaces and columns at corners.

The magnetic circuit part 330 may be disposed at a central portion of the outer body 310, the movable coil plate 331 may be disposed at a central portion of the magnetic circuit part 330, and one pair of magnetic bodies 332 may be spaced by the same distance from both side of the movable coil plate 331.

The movable coil plate 331 may have an upper end fixed to a guide groove 351 of the fixing part 350 and a lower end fixed to a damper 360 in a standing state.

A magnet 332*a* is disposed between the one pair of magnetic bodies 332, and magnetic plates (yokes) 332*b* and 332*c* are attached to top and bottom surfaces of the magnet 332*a*, respectively.

The magnetic circuit part 330 may be disposed at and fixed to the base frame 320.

The metal suspension 340 may have the same shape as that of the second embodiment of the present invention.

The metal suspension 340 has an inside edge connected to the fixing part 250 and an outside edge connected to the base frame 320.

The damper 360 may have a wrinkled shape made of a fabric material or an elastic material. The damper 360 may have both ends connected to the base frame 320 and a central top surface connected to a lower end of the movable coil plate 331.

FIG. 10 is a cross-sectional structure view illustrating a stick-type vibrating driver according to a fourth embodiment of the present invention.

The fourth embodiment of the present invention in FIG. 10 may be a modified embodiment of the third embodiment.

The fourth embodiment is different from third embodiment of the present invention in that the fourth embodiment has a separated structure in which an outer body is separated from a fixing part while the third embodiment has a structure integrated with the outer body.

Referring to FIGS. 9 and 10, the fourth embodiment is different from the third embodiment in that the fourth embodiment in FIG. 10 has the separated structure in which the outer body 410 is not connected to the fixing part 450, and the base frame 420 is connected to the base frame 420 while the third embodiment in FIG. 9 has the integrated structure in which the fixing part 350 is mounted to an inside bottom surface of the outer body 310, and the base frame 320 is not connected to the outer body 310. Except this different point, the fourth embodiment and the third embodiment have the same constitution.

That is, while the outer body 310 is attached to the vibrated object in the third embodiment in FIG. 9, the fixing part 450 is attached to the vibrated object in the fourth embodiment in FIG. 10.

FIG. 11 is a perspective view illustrating a modified stick-type vibrating driver of the first embodiment of the present invention.

FIG. 11 illustrates a modified embodiment (hereinafter, referred to as a fifth embodiment) of the first embodiment of the present invention. The embodiment in FIG. 11 is remarkably different from the first embodiment in that the embodiment in FIG. 11 is the stick-type vibrating driver having curved top and bottom surfaces while the first embodiment of the present invention is the stick-type vibrating driver having the flat top and bottom surfaces.

The stick-type vibrating driver of the present invention is a device that is attached to the vibrated object and transmits vibration caused by an external factor to the vibrated object. An attachment surface of the stick-type vibrating driver may be varied according to the kind of the vibrated object or a shape of an attachment surface of the vibrated object.

When the attachment surface of the vibrated object is a flat surface, the stick-type vibrating driver of the first to fourth embodiments of the present invention may be attached thereto, and when the attachment surface of the vibrated object is a curved surface, the stick-type vibrating driver of the embodiment in FIG. 11 may be attached thereto.

Referring to FIG. 11, the stick-type vibrating driver according to the fifth embodiment of the present invention may include an outer body 1110, a base frame 1120, a magnetic circuit part 1130, upper and lower metal suspensions 1140*a* and 1140*b*, and upper and lower fixing parts 1150*a* and 1150*b*.

A connection structure and disposed positions of the outer body 1110, the base frame 1120, the magnetic circuit part 1130, the upper and lower metal suspensions 1140*a* and 1140*b*, and the upper and lower fixing parts 1150*a* and 1150*b* are the same as those of the first embodiment of the present invention, and structures thereof are also the same as those of the first embodiment.

Here, the fifth embodiment is different from the first embodiment in that each of the outer body 1110, the base frame 1120, the magnetic circuit part 1130, the upper and lower metal suspensions 1140*a* and 1140*b*, and the upper and lower fixing parts 1150*a* and 1150*b* has a curved shape with the same curvature radius.

Substantially, the outer body 1110, which is component attached to the vibrated object, may have a surface curved by a predetermined radius, and each of the base frame 1120, the magnetic circuit part 1130, the upper and lower metal suspensions 1140*a* and 1140*b*, and the upper and lower fixing parts 1150*a* and 1150*b* may have a curved shape corresponding to the curved surface of the outer body 1110.

Each of the outer body 1110 and other components may have a curved surface that is bent in a longitudinal direction thereof, and whether the curved surface of the outer body 1110 is concave or convex may be determined according to a shape of the attachment surface of the vibrated object.

That is, when the curved surface of the vibrated object is a convex surface, a surface of the outer body 1110 attached to the vibrated object may be a concave surface, and when the curved surface of the vibrated object is a concave surface, a surface of the outer body 1110 attached to the vibrated object may be a convex surface.

Hereinabove, although only the curved stick-type vibrating driver is illustrated as the modified example of the first embodiment of present invention, the flat stick-type vibration drivers in the second to fourth embodiments may be also implemented with the same concept.

Features, structures, and effects described in the above embodiments are incorporated into at least one embodiment of the present invention, but are not limited to only one embodiment. Moreover, features, structures, and effects exemplified in one embodiment can easily be combined and modified for another embodiment by those skilled in the art. Therefore, these combinations and modifications should be construed as falling within the scope of the present invention.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

DESCRIPTION OF SYMBOLS

10: Outer body
20: Vibrating part
30: Magnetic circuit part
31: Movable coil plate
32: Magnetic body
40: Metal suspension
50: Damper

The invention claimed is:

1. A stick-type vibrating driver comprising:
an outer body;
a magnetic circuit part formed inside the outer body and comprising one pair of magnetic bodies spaced apart with a movable coil plate therebetween;
a vibrating part formed inside the outer body and comprising at least the one pair of magnetic bodies configured to vertically vibrate according to driving of the magnetic circuit part in a state in which upper and lower ends of the movable coil plate are fixed; and
upper and lower metal suspensions respectively connected between the outer body and the vibrating part, wherein each of the upper and lower metal suspensions comprises an inside edge, an outside edge, and a plurality of bridges configured to connect the inside edge and the outside edge, and the inside edge is connected to upper and lower ends of the outer body, and the outside edge is connected to the vibrating part, and
wherein the upper and lower ends of the movable coil plate are fixed to upper and lower fixing parts attached to the outer body, respectively, the vibrating part comprises a base frame configured to constitute an external case, and the inside edges of the upper and lower metal suspensions are connected to the upper and lower fixing parts, respectively, and the outside edges of the upper and lower metal suspensions are connected to outside edges of top and bottom surfaces of the base frame, respectively.

2. The stick-type vibrating driver of claim 1, wherein the outer body has a predetermined rectangular shape.

3. The stick-type vibrating driver of claim 1, wherein the upper and lower fixing parts are attached to top and bottom surfaces of the outer body, respectively.

4. The stick-type vibrating driver of claim 1, wherein the base frame is connected to the one pair of magnetic bodies.

5. A stick-type vibrating driver comprising:
an outer body;
a magnetic circuit part formed inside the outer body and comprising one pair of magnetic bodies spaced apart with a movable coil plate therebetween;
a vibrating part formed inside the outer body and comprising at least the one pair of magnetic bodies configured to vertically vibrate according to driving of the magnetic circuit part in a state in which upper and lower ends of the movable coil plate are fixed; and
upper and lower metal suspensions respectively connected between the outer body and the vibrating part, wherein each of the upper and lower metal suspensions comprises an inside edge and a plurality of free ends connected from the inside edge, and each of the plurality of free ends has a bent shape having at least one bent portion, and
wherein at least one bush is formed in the outer body, the vibrating part comprises a base frame configured to constitute an outer case, and each of front ends of the plurality of free ends of the upper and lower metal suspensions is connected to the bush, and the inside edges of the upper and lower metal suspensions are connected to outside edges of top and bottom surfaces of the base frame, respectively.

6. The stick-type vibrating driver of claim 1, wherein each of the plurality of bridges has a bent shape having at least one bent portion.

7. A stick-type vibrating driver comprising:
an outer body;
a magnetic circuit part formed inside the outer body and comprising one pair of magnetic bodies spaced apart with a movable coil plate therebetween;
a vibrating part formed inside the outer body and comprising at least the one pair of magnetic bodies configured to vertically vibrate according to driving of the magnetic circuit part in a state in which upper and lower ends of the movable coil plate are fixed; and
upper and lower metal suspensions respectively connected between the outer body and the vibrating part, wherein each of the outer body, the magnetic circuit part, the vibrating part, and the upper and lower metal suspensions is curved by a predetermined radius in a longitudinal direction, and
wherein the outer body is attached to an object to be vibrated, and when an attachment surface of the object to be vibrated is concave or convex, an attachment surface of the outer body is concave or convex.

8. A stick-type vibrating driver comprising:
an outer body attached to an object to be vibrated and having a stick shape having at least top and bottom surfaces;
a printed circuit board (PCB) movable coil plate disposed inside the top and bottom surfaces of the outer body and having fixed upper and lower ends;
a magnetic body comprising a magnet and a magnetic plate, which are spaced apart with the movable coil plate therebetween;
a base frame connected to the magnetic body; and
a metal suspension part configured to enable the base frame to vibrate by connecting each of the top and bottom surfaces of the outer body with the base frame, wherein each of the outer body, the magnetic body, the base frame, and the metal suspension part is curved by a predetermined radius in a longitudinal direction, and
wherein when an attachment surface of the object to be vibrated is concave or convex, at least one of: the top surface, or the bottom surface, of the outer body is concave or convex.

9. A stick-type vibrating driver comprising:
an outer body;
a magnetic circuit part formed inside the outer body and comprising one pair of magnetic bodies spaced apart with a movable coil plate therebetween;
a vibrating part formed inside the outer body and comprising at least the one pair of magnetic bodies configured to vertically vibrate according to driving of the magnetic circuit part in a state in which upper and lower ends of the movable coil plate are fixed;
a metal suspension connected between the outer body and an upper end of the vibrating part; and
a damper connected to a lower end of the movable coil plate and a lower side of the vibrating part, wherein each of the outer body, the magnetic circuit part, the vibrating part, and the metal suspension is curved by a predetermined radius in a longitudinal direction, and wherein the outer body is attached to an object to be vibrated, and when an attachment surface of the object to be vibrated is concave or convex, an attachment surface of the outer body is concave or convex.

10. A stick-type vibrating driver comprising:

a fixing part attached to an object to be vibrated;

an outer body;

a magnetic circuit part formed inside the outer body and comprising one pair of magnetic bodies spaced apart with a movable coil plate therebetween;

a vibrating part connected to an inside surface of the outer body and comprising at least the one pair of magnetic bodies configured to vertically vibrate according to driving of the magnetic circuit part in a state in which an upper end of the movable coil plate is fixed to the fixing part, and a lower end of the movable coil plate is fixed to a damper, the damper connected to a lower side of the vibrating part;

a metal suspension connected between the outer body and the fixing part, wherein each of the fixing part, the outer body, the magnetic circuit part, the vibrating part, and the metal suspension is curved by a predetermined radius in a longitudinal direction, and wherein when an attachment surface of the object to be vibrated is concave or convex, the fixing part is concave or convex.

* * * * *